US012157155B2

(12) United States Patent
Ernst De La Graete

(10) Patent No.: US 12,157,155 B2
(45) Date of Patent: Dec. 3, 2024

(54) TOOL AND METHOD FOR CHANGING THE WORKING ROLL IN A ROLLING MILL

(71) Applicant: FIVES DMS, Lezennes (FR)

(72) Inventor: Conrad Ernst De La Graete, Seclin (FR)

(73) Assignee: FIVES DMS, Lezennes (FR)

( * ) Notice: Subject to any disclaimer, the term of this patent is extended or adjusted under 35 U.S.C. 154(b) by 237 days.

(21) Appl. No.: 17/908,627

(22) PCT Filed: Mar. 9, 2021

(86) PCT No.: PCT/FR2021/050394

§ 371 (c)(1),
(2) Date: Sep. 1, 2022

(87) PCT Pub. No.: WO2021/181039

PCT Pub. Date: Sep. 16, 2021

(65) Prior Publication Data

US 2023/0119712 A1 Apr. 20, 2023

(30) Foreign Application Priority Data

Mar. 10, 2020 (FR) ..... 20 02381

(51) Int. Cl.
*B21B 31/10* (2006.01)
*B21B 13/14* (2006.01)

(52) U.S. Cl.
CPC ..... *B21B 31/103* (2013.01); *B21B 13/147* (2013.01)

(58) Field of Classification Search
CPC ..... B21B 31/10; B21B 31/103; B21B 31/106; B21B 13/147
See application file for complete search history.

(56) References Cited

U.S. PATENT DOCUMENTS

| | | | | |
|---|---|---|---|---|
| 5,193,377 A | | 3/1993 | Sendzimir et al. | |
| 5,471,859 A | | 12/1995 | Sendzimir et al. | |
| 6,098,439 A | * | 8/2000 | Lecrivain | B21B 31/103 72/239 |
| 2019/0337781 A1 | | 11/2019 | Schlott | |

FOREIGN PATENT DOCUMENTS

| | | | | |
|---|---|---|---|---|
| CN | 109264637 A | | 1/2019 | |
| DE | 3019059 A1 | | 11/1981 | |
| EP | 0684089 A2 | | 11/1995 | |
| JP | 59202107 A | * | 11/1984 | B21B 31/10 |
| JP | H0832336 B2 | * | 3/1996 | B21B 31/103 |
| JP | H10263634 A | * | 10/1998 | B21B 31/10 |

OTHER PUBLICATIONS

Translation of JP-H10263634 (Year: 1998).*
Translation of JP-H0832336 (Year: 1996).*
International Search Report (with English Translation) and Written Opinion (with Machine Translation) issued on Jun. 21, 2021 in corresponding International Patent Application No. PCT/FR2021/050394; 18 pages.

* cited by examiner

*Primary Examiner* — Bobby Yeonjin Kim
(74) *Attorney, Agent, or Firm* — Maier & Maier, PLLC

(57) ABSTRACT

A method for changing work roll in a rolling mill which limits the risk of scratching the work roll, or even the risk of scratching the metal strip, upon extracting or inserting the work roll, by virtue of a mechanical separation element, in particular of the branches of a fork system, inserted by a robotic element.

25 Claims, 10 Drawing Sheets

TOOL AND METHOD FOR CHANGING THE WORKING ROLL IN A ROLLING MILL

FIELD

The invention is related to a method for changing work rolls of a rolling mill in the presence of a metal strip to be rolled between both work rolls, including an upper work roll and a lower work roll suitable for extracting the work rolls from the roll stand.

The invention further relates to a method for changing the work rolls of a rolling mill in the presence of a metal strip to be rolled between both work rolls, including an upper work roll and a lower work roll, suitable for inserting and placing the lower or upper, in particular new or ground, work rolls.

The present disclosure further relates to a work roll changing tool configured for carrying out the method suitable for extracting work rolls and/or for inserting and placing upper and/or lower, in particular new or ground, work rolls into the roll stand.

BACKGROUND

The present invention thus finds advantageous application for multi-roll mills, such mills typically being "Sendzimir" mills.

Cold rolling makes it possible to obtain the final thickness of a metal strip by successive passages of this strip between rolls in the presence of high forces simultaneously in pressure and pulling.

A "Sendzimir" type rolling mill includes a plurality of rolls, or rollers, which are arranged in relation to each other to allow change of the mechanical characteristics of a metal strip and to obtain a strip thickness which may be less than 3 millimetres.

More particularly, a "Sendzimir" rolling mill which may include twenty rolls is known; one exemplary embodiment of such a twenty-roll mill is illustrated in U.S. Pat. Nos. 5,193,377 and 5,471,859.

FIG. 12 represents a schematic view of a transverse cross-section of a twenty-roll mill. In this figure, the rolls are divided into a lower group LG and an upper group UG; more precisely, these groups LG and UG have a symmetrical structure and each include ten rolls, of which: a work roll 12, two first intermediate rolls 13, three second intermediate rolls 14 and 15, and four back-up rolls, or back-up rollers, which are outside the arrangement and which are noted A, B, C and D for the upper group UG and E, F, G, H for the lower group LG.

This nomenclature for the various rolls making up a twenty roll mill is customary in the field of rolling mills, and is well known to the person skilled in the art.

It is recognised in the field of rolling mills that this arrangement of rolls illustrated in FIG. 12 allows for efficient work of a metal strip MS to obtain the desired strip thickness.

Due to the stresses exerted on the work rolls 12 and upon working a metal strip MS, these parts 12 require very regular maintenance: it is therefore desirable to be able to remove and replace the work rolls 12 quickly, and safely for the operators.

In a 20-roll ("20 Hi") rolling mill, it is still noticed that the opening of the stand is small, in particular when the roll stand is a single piece, because obtained in this case only by the backup rollers eccentrically outwardly pivoting (A, B, C, D for the upper group UG and E, F, G, H for the lower group LG). According to the inventor's findings, there is a significant risk of collisions and friction between the work roll, during its extraction (or insertion) and the components of the surrounding rolling mill such as the first two intermediate rolls 13, or even the metal strip MS present in the stand.

There is a need to be able to change work rolls, without marking the metal strip, without worsening the surface condition of the work roll, or even the first intermediate rolls, either during the removal step, or upon placing a new or ground work roll in the roll stand.

The present disclosure thus finds particular application for changing the work rolls of a cold rolling mill, typically used to perform bright annealing. In such a mill, the work rolls have a so-called mirror polish surface condition at a very low roughness.

PRIOR ART

Based on the knowledge of the applicant, from prior art, robotic systems are known, such as a multi-axis arm equipped with a gripper configured to ensure removal of the rolls from a rolling mill. These robotic systems allow for the removal of rolls from the rolling mill with minimal risk of injury to operators, and in comparison with hoist changeover methods, which require the physical presence of an operator in the proximity of the work roll being handled, to conduct extraction of the roll and its replacement with a new or ground roll.

However, and based on the inventor's findings, none of the known robotic systems can guarantee safe extraction (or insertion) of the work rolls, in a 20 Hi rolling mill, avoiding the risks of marking between the work roll, on the one hand, and the metal strip, or even the first intermediate rolls, on the other hand.

SUMMARY

The present disclosure improves the situation.

According to a first aspect, there is provided a method for changing work rolls of a rolling mill in the presence of a metal strip to be rolled between both work rolls, including an upper work roll and a lower work roll, and wherein in a closing position of the roll stand configured to roll the metal strip, said work rolls each have a contact generatrix with the metal strip, the contact generatrices and the axes of the work rolls lying in a plane substantially perpendicular to a running direction of the metal strip, rolling members such as first intermediate rolls being in contact along two contact generatrices between each of the work rolls and the rolling members, the rolling members ensuring transmission of a rolling force to the lower and upper work rolls in contact with the metal strip, method in which extraction of the work rolls from the roll stand is ensured after at least partially opening the roll stand for which the work rolls are spaced apart from each other with respect to the positions of the work rolls in the closing position of the roll stand by carrying out the following steps, for said upper and/or lower work roll:

an insertion step a) comprising:

robotically inserting mechanical separation means between said work roll and the metal strip to a separation position in which the metal strip and said work roll are physically separated along the length of the work roll, and until ensuring suppression of the contact between the work roll and the metal strip and/or robotically inserting mechanical separation means between the work roll and the rolling members to a separation position in which said work roll and the rolling members are physically separated along the length of the work roll, until ensuring removal of the contact between the work roll and the rolling members, a removal step b) comprising:

robotically extracting said work roll, by gripping one end of said work roll and moving said work roll along its axis with respect to the metal strip and the rolling members present in the roll stand, wherein said mechanical separation means are:

in said separation position in which the work roll and the metal strip are physically separated so as to avoid any friction between the work roll and the metal strip upon moving, or/and in said separation position in which the work roll and the rolling members are physically separated and so as to avoid any friction between the work roll and the rolling members upon moving.

According to a second aspect, there is provided a method for changing the work rolls of a rolling mill in the presence of a metal strip to be rolled between both work rolls, including an upper work roll and a lower work roll, and wherein in a closing position of the roll stand configured to roll the metal strip, said work rolls each have a contact generatrix with the metal strip, the contact generatrices and the axes of the work rolls lying in a plane substantially perpendicular to a running direction of the metal strip, rolling members, such as first intermediate rolls, being in contact along two contact generatrices between each of the work rolls and the rolling members, the rolling members ensuring transmission of a rolling force to the lower and upper work rolls in contact with the metal strip (MS), method in which insertion of the new or ground work rolls into the roll stand is ensured in the presence of the metal strip and the rolling members after at least partially opening the roll stand by carrying out the following steps, for said upper work roll and/or the lower work roll an insertion step c) comprising:

robotically inserting mechanical separation means between the metal strip and the work roll to be inserted ensuring suppression of the contact between the work roll and the metal strip and/or robotically inserting mechanical separation means between the rolling members and said work roll to be inserted ensuring suppression of the contact between the work roll and the rolling members an insertion step d), concurrent or subsequent to the insertion step c) comprising inserting said work roll robotically, by pushing one end of said work roll and moving said work roll along its axis with respect to the metal strip and the rolling members present in the roll stand, wherein said mechanical separation means are:

in a separation position in which the work roll and the metal strip are physically separated so as to avoid any friction between the work roll and the metal strip upon moving, or/and in a separation position in which the work roll and the rolling members are physically separated so as to avoid any friction between the work roll and the rolling members upon moving.

According to a third aspect, the present disclosure relates to a tool suitable for changing work rolls of a rolling mill configured to be handled by motor means comprising:

a fork system comprising two branches configured to be inserted into the stand of a rolling mill in a position of the branches spaced apart on either side of an upper work roll of the rolling mill, said branches being movable relative to a fork support, said branches being configured to move from their spaced apart position to a close position in which the branches ensure lifting of the upper work roll guaranteeing physical separation between the work roll and the metal strip upon extracting a work roll, and/or the fork system comprising both branches configured to be inserted in the stand of a rolling mill in their close position, said branches being movable with respect to a fork support, configured to move from their close position to their spaced apart position to cause the upper, work roll to be deposited onto the metal strip a gripping device, comprising a gripper connected by an actuator to the fork support, configured to grip one end of the work roll and to pull the work roll along the branches of the fork system, in particular upon extracting the work roll, or even configured to push the work roll along the branches of the fork system upon inserting a new or ground work roll.

According to one embodiment, a movable backup element connected by a second actuator to the fork support is configured to ensure locking of the end of the work roll gripped and pulled by the gripping device, clamped between the movable backup element and a counter-backup element in the vicinity of the fork support, when the branches are in a close position.

According to one embodiment, the tool may comprise two wings, with an insert function, respectively integral with both branches of the fork system and ensuring:

when both branches are moved closer to each other, and concurrently to the insert wings, from their spaced apart position to their close position, the mechanical separation between the work roll and the rolling members, in which said work roll and the rolling members are physically separated along the length of the work roll, by said insert wings guaranteeing suppression of the contact between the work roll and the rolling members, in particular suppression of both contact generatrices of the lower work roll with the rolling members, and/or releasing the lower work roll on the insert wings between the work roll and the rolling members, in the close position of the branches in the roll stand, and then depositing the lower work roll onto the rolling members when the branches and the insert wings have moved from their close position to their spaced apart position.

BRIEF DESCRIPTION OF THE DRAWINGS

Further characteristics, details and advantages will become apparent upon reading the following detailed description, and analysing the appended drawings, in which.

DESCRIPTION

Figure 1:
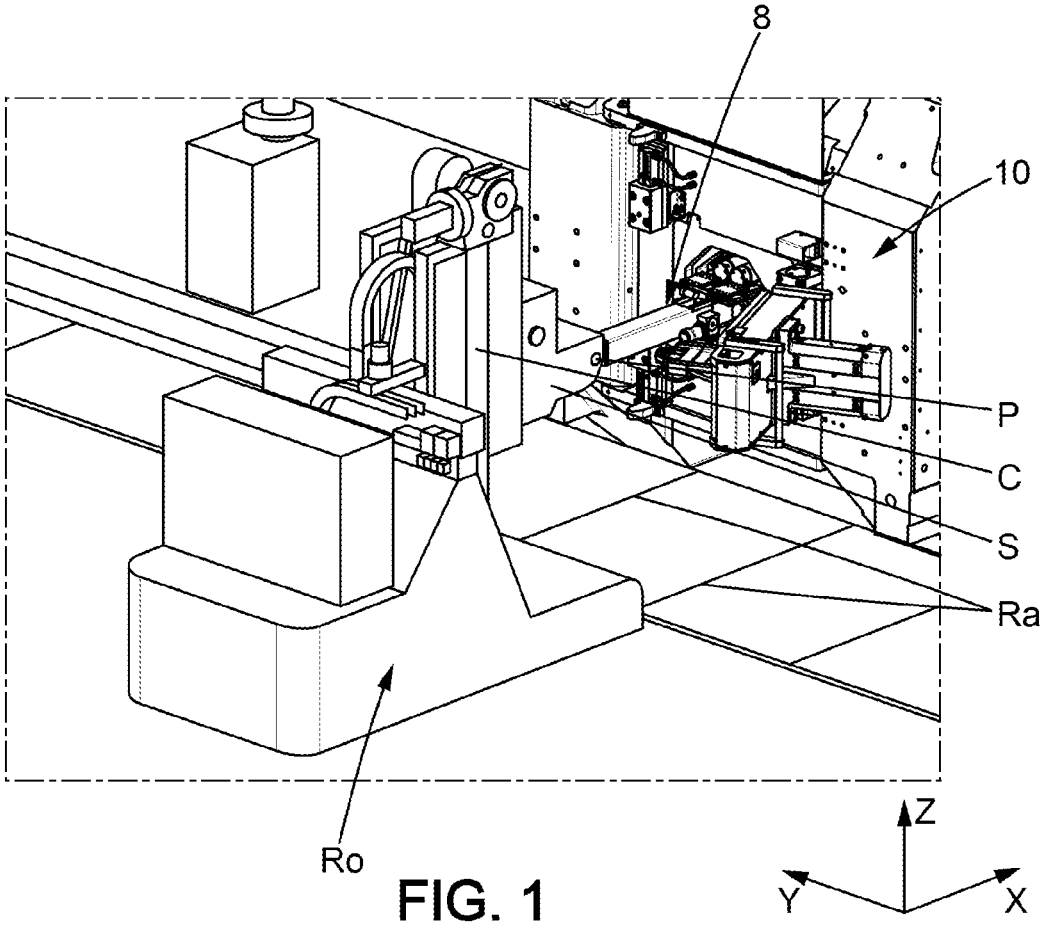
FIG. 1 shows a perspective view of a robot handling a work roll changing tool according to the present disclosure, and suitable for carrying out the method according to the present disclosure, the robot placed in the work zone in front of a 20-roll rolling mill, facing the access to the work rolls, after opening a gate.
Figure 2:
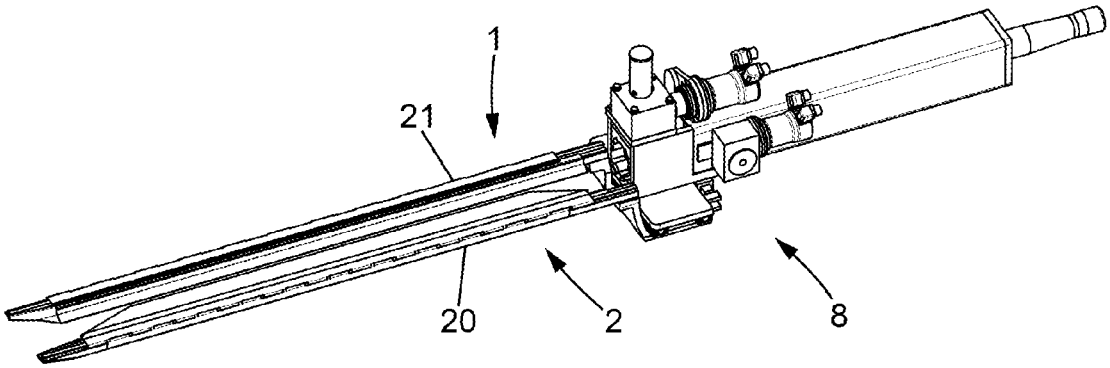
FIG. 2 is a perspective view of the work roll changing tool, in a position relative to the metal strip allowing gripping of the upper work roll, the components of the rolling mill not being illustrated.

The following drawings and description contain, for the most part, elements of certainty. Therefore, they may serve not only to further the understanding of the present disclosure, but also to help define it, if necessary.

Thus, the present disclosure first relates to a method for changing the work rolls 12 of a rolling mill referenced 10, in the presence of a metal strip MS to be rolled between both work rolls 12, including an upper work roll, and a lower work roll.

In a closing position of the roll stand configured to roll the metal strip MS, the work rolls 12 each have a contact generatrix with the metal strip, the contact generatrices and the axes of the work rolls 12 lying in a plane substantially perpendicular to a running direction of the metal strip.

In the closing position of the stand, rolling members such as first intermediate rolls 13 are in contact along two contact generatrices between each of the work rolls 12 and the rolling members, the rolling members ensuring transmission of a rolling force to the lower and upper work rolls 12 in contact with the metal strip MS.

According to the method of the present disclosure, extraction of the work rolls 12 from the roll stand is ensured after at least partially (or even totally) opening the roll stand in which the work rolls 12 are spaced apart from each other, and with respect to the positions of the work rolls 12, in the closing position of the roll stand, by carrying out the following steps for said upper and/or lower work roll an insertion step a) comprising:

robotically inserting mechanical separation means 1 between said work roll 12 and the metal strip MS to a separation position SP1 in which the metal strip MS and said work roll 12 are physically separated along the length of the work roll, and up to guarantee suppression of the contact between the work roll 12 and the metal strip MS and/or robotically inserting mechanical separation means 1 between the work roll 12 and the rolling members to a separation position SP2 in which said work roll 12 and the rolling members are physically separated along the length of the work roll, up to guarantee suppression of the contact between the work roll 12 and the rolling members, a removal step b) comprising:

robotically extracting said work roll 12, by gripping one end of said work roll 12 and moving said work roll 12 along its axis with respect to the metal strip MS and the rolling members present in the roll stand, wherein said mechanical separation means are:

in said separation position SP1 in which the work roll 12 and the metal strip MS are physically separated so as to avoid any friction between the work roll and the metal strip upon moving, or/and in said separation position SP2 in which the work roll 12 and the rolling members are physically separated and so as to avoid any friction between the work roll and the rolling members upon moving.

Thus and notably, the method comprises an insertion step a), prior to the removal step b), with robotic insertion of mechanical separation means guaranteeing suppression of the contact between the work roll 12 and the metal strip MS, in the separation position SP1, and alternatively or preferably additionally, with robotic insertion of mechanical separation means guaranteeing suppression of the contact between the work roll 12 and the rolling members, in the separation position SP2.

The removal step b) is then implemented while said mechanical separation means are in said separation position SP1 in which the work roll 12 and the metal strip MS are physically separated or/and preferably in said separation position SP2 in which the work roll 12 and the backup members are physically separated from each other.

The method according to the present disclosure advantageously makes it possible, during the removal step b), to avoid any friction between the work roll, on the one hand, and the metal strip and/or the rolling members, upon moving the work roll for removing it from the roll stand.

It becomes possible to extract the lower or upper work roll without marking the work roll, or without marking neither the metal strip nor the rolling elements upon removing the work roll by moving along its axis.

Figure 12:
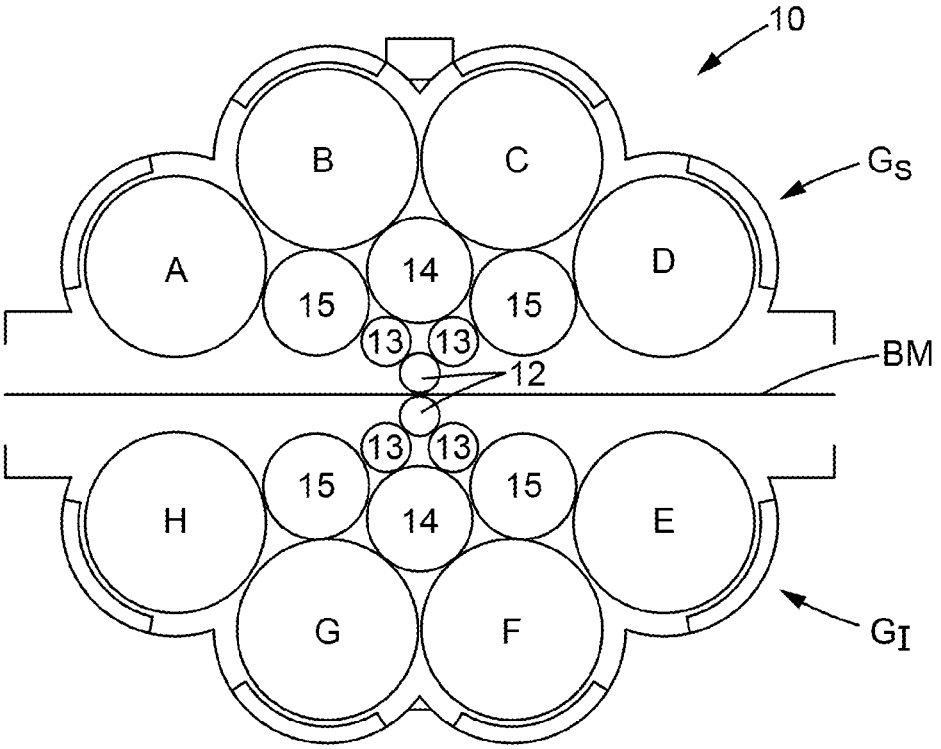
FIG. 12 is a schematic representation of the configuration of a 20-roll mill.

The method according to the present disclosure finds particular application in a 20Hi rolling mill as represented schematically in FIG. 12.

The method according to the present disclosure can advantageously be implemented by a roll changing tool 8, comprising a fork system, with two branches 20, 21. When the branches 20, 21 are inserted between the metal strip MS and the work roll 12 to be extracted, parallel to the axis of the work roll, said branches, advantageously interposed between the metal strip MS and the work roll 12, make it possible to guarantee suppression of the contact between the metal strip and the work roll.

Thus, the insertion step a) and the extraction step b) can be carried out for the upper work roll 12, and as visible in FIGS. 5 to 9, the separation means 1 between said upper work roll 12 and the metal strip MS comprising said fork system 2 with its two branches 20, 21, parallel to each other, held to a same fork support 22.

Figure 6:
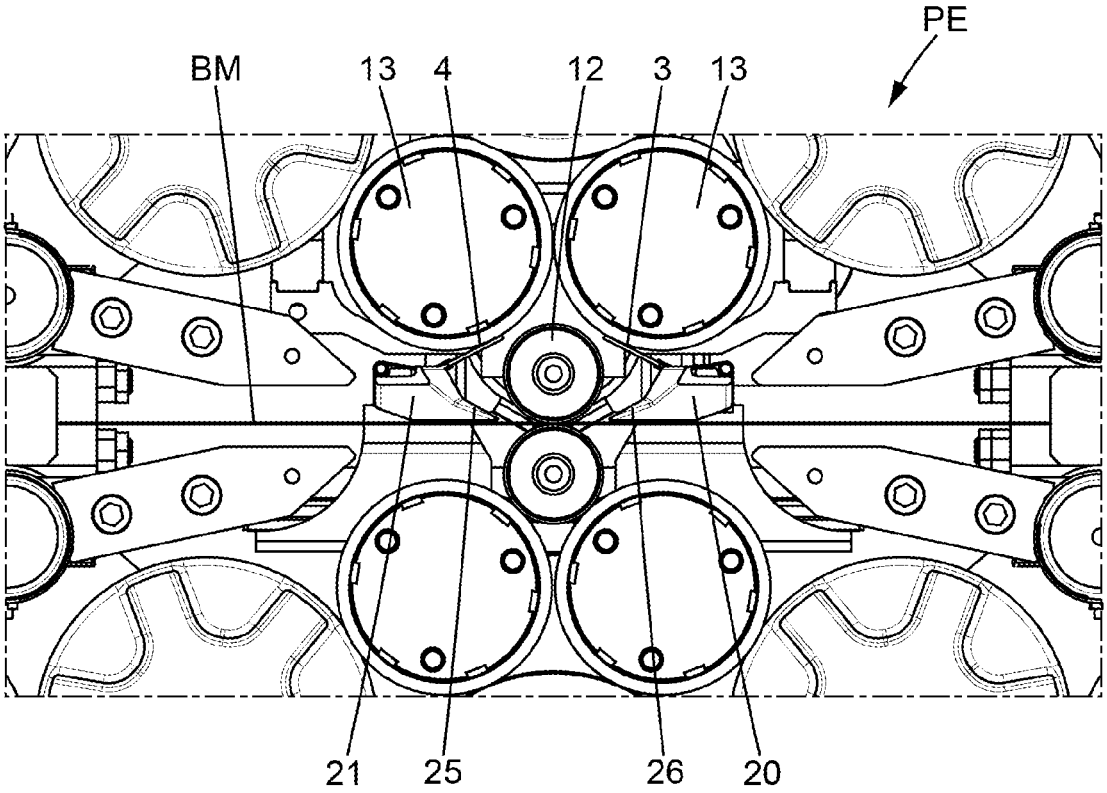
FIG. 6 is a cross-sectional view of FIG. 5, along a vertical sectional plane parallel to the running direction of the metal strip in the rolling mill, the cross-sectional view particularly illustrating both branches and said wings, in their spaced apart position, on either side of the upper work roll, and of the clamping plane passing through the axes of both work rolls.
Figure 7:
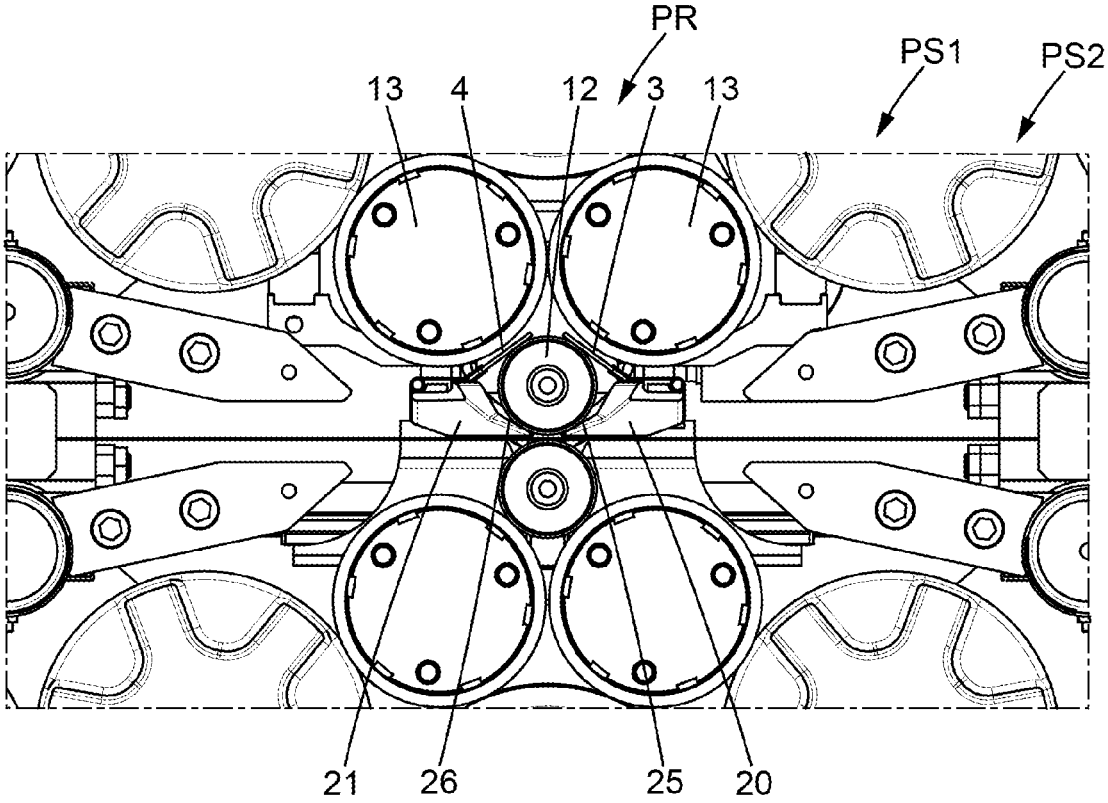
FIG. 7 is a cross-sectional view subsequent to FIG. 6, with both branches moved to their close position, coming into contact with the work roll by lifting it until the contact generatrix with the metal strip is suppressed, both wings integral with both branches concurrently ensuring mechanical separation between the work roll, on the one hand, and the first two intermediate rolls, on the other hand.

Both branches 20, 21 of the fork system are movable with respect to said fork support, to assume, on the one hand, a spaced apart position SAP, visible in FIG. 6, configured to ensure insertion of both branches 20, 21 of the fork system, on either side of the upper work roll, without friction with said upper work roll 12, currently is still in contact with the metal strip via the contact generatrix, and on the other hand a close position CP, visible in FIG. 7, in which both branches of the fork system are moved closer to each other.

In the close position CP, both branches are advantageously configured so as to come into contact respectively with two generatrices of the upper work roll 12 in order to space apart the upper work roll from the metal strip MS by lifting it, thus suppressing contact between the upper work roll and the metal strip, and as visible in FIG. 7.

To this end, and according to one embodiment, both branches 20, 21 of the fork system 2 can advantageously have a cross-section, along a plane perpendicular to the direction of the branches 20, 21, comprising two slopes 25, 26, belonging to both branches 20, 21 facing each other respectively, tilted with respect to the plane of the metal strip MS along the running direction of the metal strip. Both slopes 25, 26 are configured to come into contact with two generatrices of the upper work roll 12 to ensure lifting of the upper work roll, by forming a cradle for holding the upper work roll 12, in the close position CP of the branches 20, 21 of the fork system 2.

Notably, the branches 20, 21 of the fork system may have a metal body machined to form the slopes 25, 26. A protective coating, for example of plastic or Teflon, may cover the metal body at least at the slopes 25, 26 intended to come into contact with the work roll 12. Such a coating makes it possible to protect the surface condition of the work roll when the latter is made to roll or slide on the slopes 25, 26 of the branches, and thus to avoid marking/scratching the work roll.

According to one advantageous embodiment:

the separation means between said work roll 12 and the metal strip MS comprise said fork system 2, including both branches 20, 21, movable with respect to each other from their spaced apart position SAP to the close position CP in which both branches 20, 21 of the fork system are interposed between said upper or lower work roll 12 and the metal strip MS guaranteeing suppression of the contact between the work roll 12 and the metal strip MS, and additionally the mechanical separation means between said work roll 12 and the rolling members, especially the first intermediate rolls 13, comprise two wings 3, 4, with an insert function, respectively hingedly integral with said two branches 20, 21 of the fork system and concurrently ensuring, when both branches 20, 21 move close to each other from their spaced apart position SAP to their close position CP the mechanical separation between the work roll 12 and the rolling members, wherein said work roll 12 and the rolling members are physically separated along the length of the work roll by said wings 3, 4 as an insert guaranteeing suppression of the contact between the work roll 12 and the rolling members.

Figure 3:
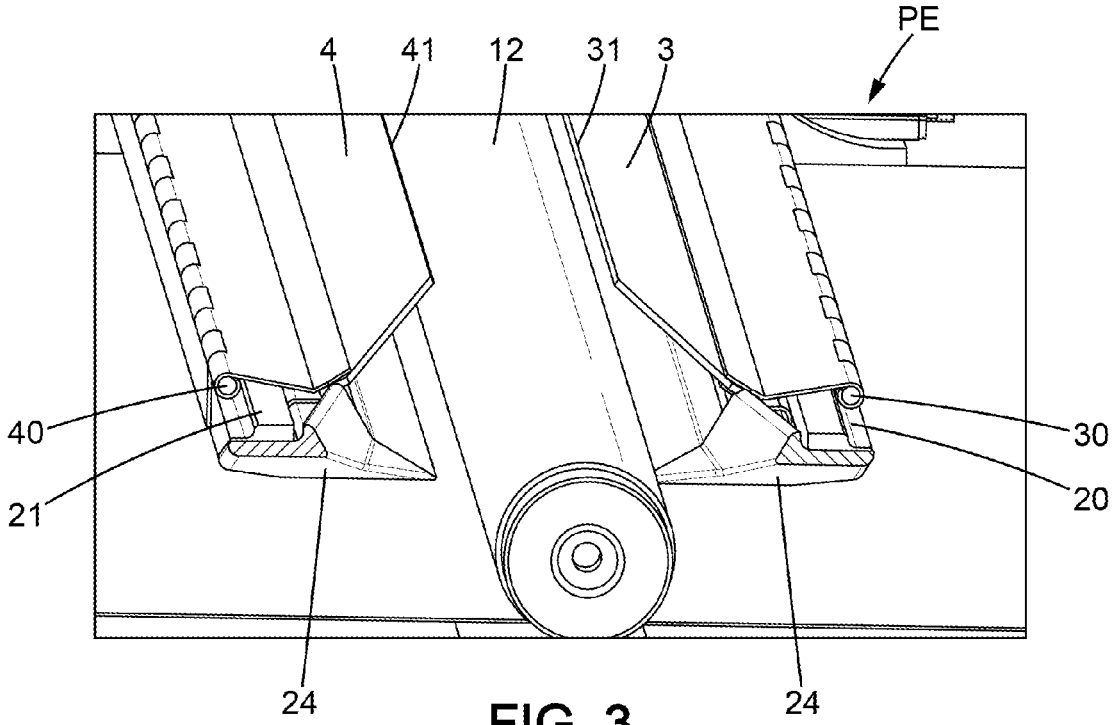
FIG. 3 is a detail view of FIG. 2, illustrating the free ends of the branches of the fork system, but also two wings with an insert function, respectively hinged to said branches, and extending along the length of the branches, said wings being configured to be inserted between the work roll, on the one hand, and respectively the first intermediate rolls, on the other hand, during the motion of the branches of the fork system towards each other, from their spaced apart position to their close position.

Thus, and in FIG. 3, it is noticed that both branches 20 and 21 of the fork system are provided with a first wing 3, and a second wing 4 respectively. The first wing 3 extends longitudinally to the branch 20, and is hinged along a pivot axis 30 to said branch 20 and the second wing 4 extends longitudinally to the branch 21, and is hinged along a pivot axis 40 to the other branch 21.

It is noticed that both wings 3 and 4 extend, along a cross-section perpendicular to the direction of the branches of the fork system, from their pivot axis 30 or 40, toward each other, each being tilted with respect to the plane passing through the axes of both branches, by an angle allowing introduction of a free edge 31, or 41, of each of the wings 3 or 4 between the work roll and the corresponding rolling members, namely both of the first intermediate rolls in the case of a 20Hi rolling mill.

Thus, and according to one embodiment of the method:

the separation means between said work roll and the metal strip comprise said fork system 2, including both branches 20, 21, movable with respect to each other from their spaced apart position SAP to the close position CP in which both branches 20, 21 of the fork system are interposed between said upper or lower work roll 12 and the metal strip MS guaranteeing suppression of the contact between the work roll 12 and the metal strip MS and the mechanical separation means between said work roll 12 and the rolling members comprise both wings 3, 4, with an insert function, respectively hingedly integral with said two branches 20, 21 of the fork system and concurrently ensuring, when both branches 20, 21 move closer to each other from their spaced apart position SAP to their close position CP, mechanical separation between the work roll and the rolling members, wherein said work roll 12 and the rolling members are physically separated along the length of the work roll, by said wings 3, 4 as an insert, guaranteeing suppression of the contact between the work roll 12 and the rolling members.

Thus, and in FIG. 6, upon extracting the upper work roll 12, it is noticed that the branches 20, 21 of the fork system moving closer to each other not only allows the branches 20, 21 to lift the upper work roll 12 by spacing it apart from the metal strip MS, but moreover allows insertion of the wing referenced 3 between the work roll 12 and one of the first two intermediate (left) rolls 13, but also the insertion of the wing marked 4, between the work roll 12 and the other (right) of the first two intermediate rolls.

It is then possible to extract the upper work roll, without any risk of friction with the metal strip MS, by virtue of the branches 20, 21 interposed between the work roll 12 and the metal strip, but also without any risk of friction between the work roll 12 and the first two intermediate rolls, by virtue of the wings 3, 4 interposed between the work roll and the first two intermediate rolls 13 respectively.

According to one embodiment of the present disclosure, the insertion step a) and the extraction step b) are carried out for the lower work roll, and wherein said separation means between said work roll and the metal strip comprise the fork system 2 comprising both branches 20, 21 parallel to each other, held to a same fork support 22 and wherein both branches of said fork system have free ends 23, advantageously provided with slopes 24.

Figure 4:
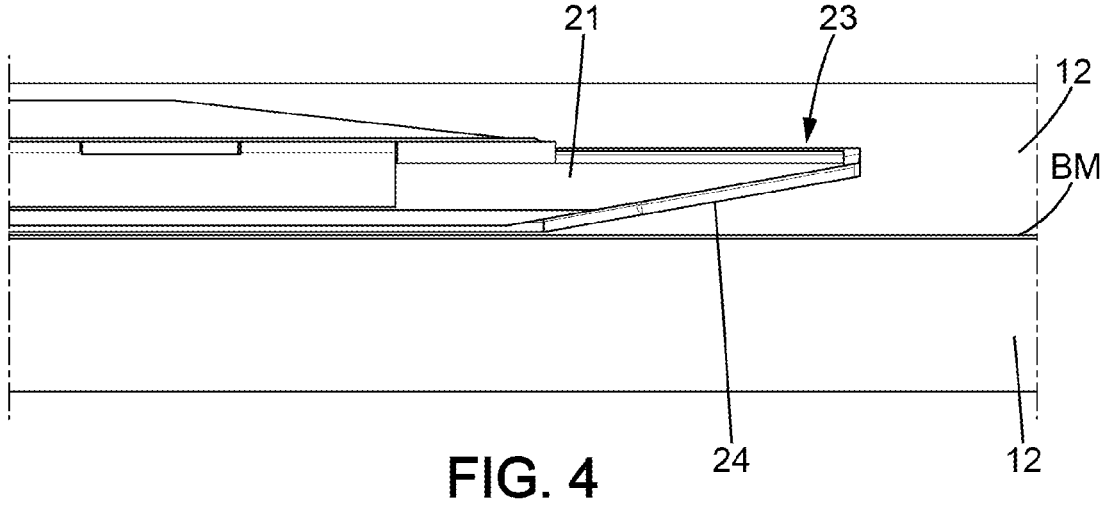
FIG. 4 is a view of FIG. 2, along a vertical plane passing through one of the branches of said fork system, illustrating the free end with its slope configured to lift the metal strip and move it away from the lower work roll.
Figure 5:
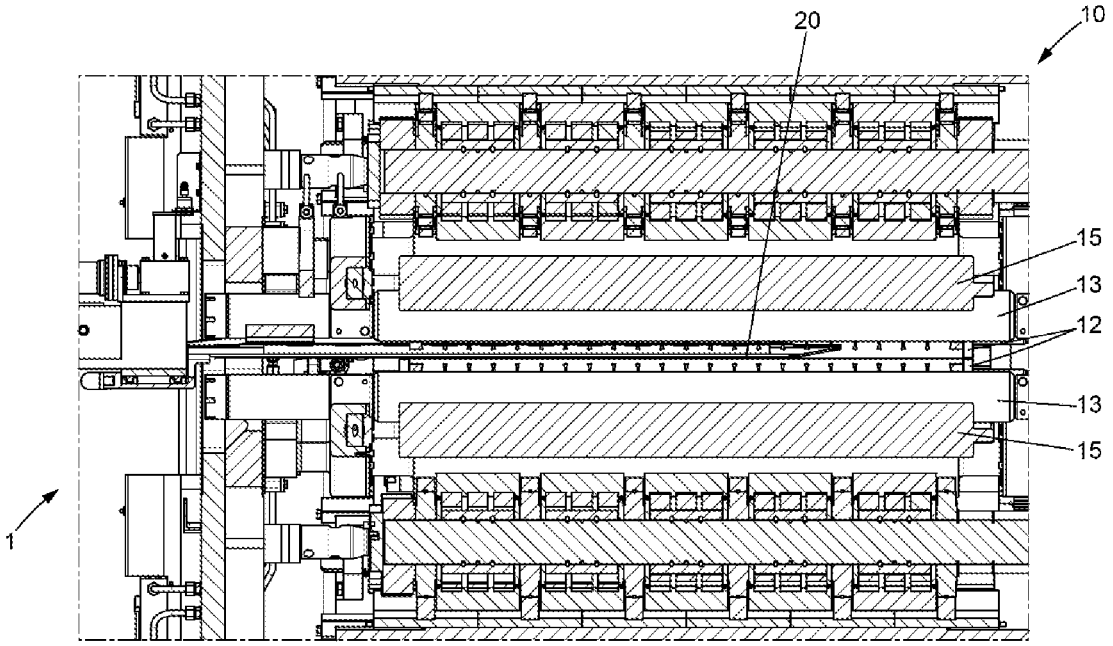
FIG. 5 is a cross-sectional view, along a plane passing through the axis of a second intermediate roll, illustrating the insertion of the branches of the fork system, in the spaced apart position of said branches, and together with the insertion of the insert wings.

These slopes 24 are particularly visible in FIGS. 3 and 4 and are tilted with respect to the plane of the metal strip MS, along the direction perpendicular to the running direction of the metal strip, when both branches 20, 21 of the fork system have axes contained in a plane parallel to the plane of the metal strip MS.

Figure 13:
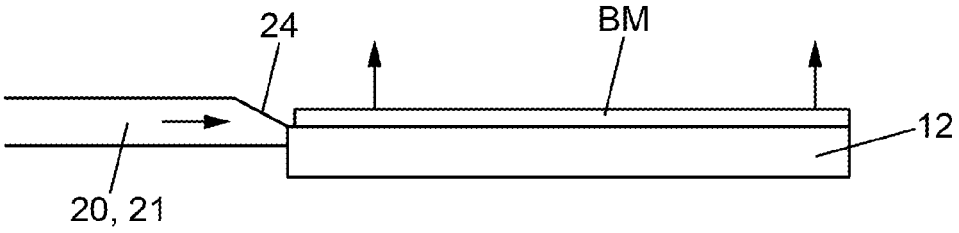
FIG. 13 is a schematic representation illustrating positioning of the fork branches, prior to insertion between the metal strip and the work roll, in order to lift the metal strip and move it away from the lower work roll.
Figure 14:
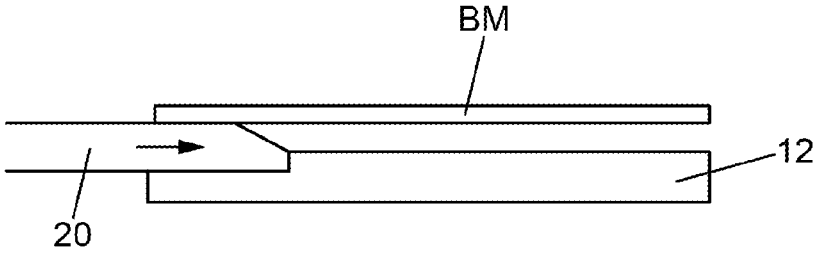
FIG. 14 is a view subsequent to FIG. 13, illustrating lifting of the metal strip and spacing it apart from the lower work roll, by the insertion motion of the fork branches, and working of the slopes at the free ends of the branches of the fork system.

As illustrated in FIGS. 13 and 14, these slopes 24 are advantageously configured to cooperate with the edge of the metal strip MS to lift the metal strip upon insertion of the branches 20, 21 in a movement parallel to the direction of the lower work roll, causing the metal strip MS to be spaced apart from the lower work roll 12, and thus suppressing contact between the lower work roll 12 and the metal strip MS.

Both branches can be directly inserted in their close position CP when the work roll changing tool is free of the wings 3, 4 with insert function. Alternatively, and when both branches 20, 21 are provided with said wings 3 and 4, said branches 20, 21 are inserted during the insertion step a), in their spaced apart position SAP between the metal strip MS, and the lower work roll 12, and as visible in FIG. 10.

Figure 10:
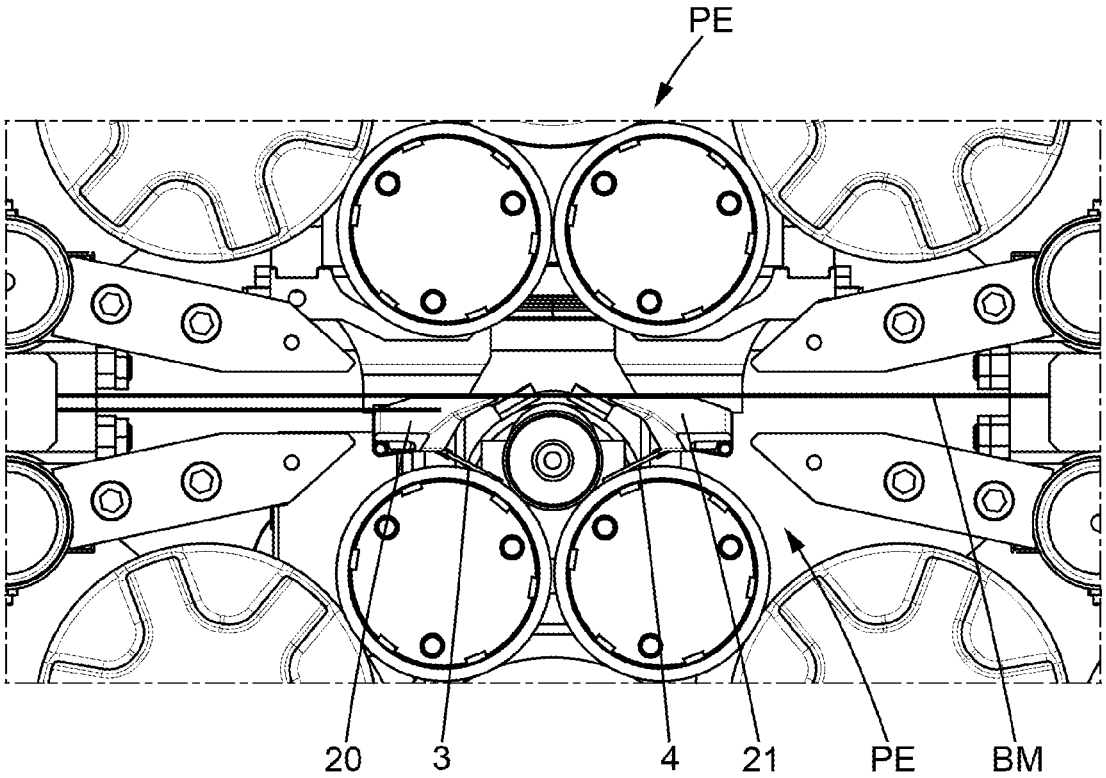
FIG. 10 is a cross-sectional view, along a vertical sectional plane, parallel to the running direction of the metal strip in the rolling mill, particularly illustrating both branches and said wings, in their spaced apart position, on either side of the lower work roll, and of the clamping plane passing through the axes of both work rolls, said lower roll bearing by two contact generatrices with the first intermediate rolls of the rolling mill.

Advantageously, the movement from the spaced apart position SAP of both branches 20, 21 as shown in FIG. 10, to the close position CP, not only makes it possible to interpose both branches 20, 21 of the fork system between the lower work roll 12 and the metal strip, guaranteeing not only suppression of any contact between the metal strip MS and the lower work roll 12, but also to interpose concurrently the wings 3 and 4, between the lower work roll and the rolling members, in particular the first two intermediate rolls. It is noticed indeed that the branches 20, 21 moving closer to each other causes the wings 3, 4 to do the same, until a position of the wing referenced 3 inserting between the lower work roll 12 and the left-hand one of the first intermediate rolls, the wing referenced 4 inserting between the lower work roll 12 and the first, right-hand, intermediate roll 13.

It is thereby possible to extract the lower work roll 12, without any risk of friction with the metal strip MS, by virtue of the branches 20, 21 interposed between the work roll 12, especially the upper or lower one, and the metal strip MS, but also without any risk of friction between the work roll 12, especially the lower or upper one, and the first two intermediate rolls, by virtue of the wings 3, 4 interposed between the work roll and the first two intermediate rolls 13 respectively.

The wings 3, 4 with an insert function may be made of a plastic material, or the like, at least at its surfaces to come into contact with the work roll and the rolling members, in particular the first intermediate rolls.

According to one embodiment of the present disclosure, gripping the end of the work roll during the removal step b) is implemented by a gripping device 5 configured to grip the end of the work roll comprising a gripper 50 with an electromagnetic suction cup, or a pneumatic suction cup cooperating with a base of the roll, or having a clamp whose jaws engage the cylindrical periphery of the end of the roll.

According to one embodiment, the removal step b) is implemented by moving the gripper 50 of the gripping device 5 along the direction of the work roll so as to ensure that the work roll 12 is pulled.

According to one embodiment of the present disclosure, the gripping device 5 comprises said gripper 50, but also an actuator 51 connecting the fork support 22 to the gripper 50, configured to move the gripper 50 relative to the fork support 22, along a direction parallel to the branches of the fork system. For example in FIG. 8, the gripping device comprises a gripper 50, especially an electromagnetic suction cup, and the actuator comprises a rack 52. This rack 52 supports the gripper 50 at one end thereof. A motor unit, 53 integral with the fork support 22, comprises a pinion (not visible because it is internal) which meshes with teeth of the rack. The motor drive of the pinion in one direction of rotation allows the gripper 50 to be pulled in the direction of the branches 20, 21 of the fork system 2. The motor drive of the pinion in the opposite direction allows the work roll to be pushed into the roll stand upon inserting a new or ground work roll.

According to one embodiment of the present disclosure, a movable backup element 6 connected by a second actuator 60 to the fork support 22 is configured to ensure locking of the end of the work roll gripped and pulled by the gripping device 5, the roll being locked, clamped between the movable backup element 6 and a counter-backup element 7 in the vicinity of the fork support, when the branches are in the close position CP.

Figure 8:
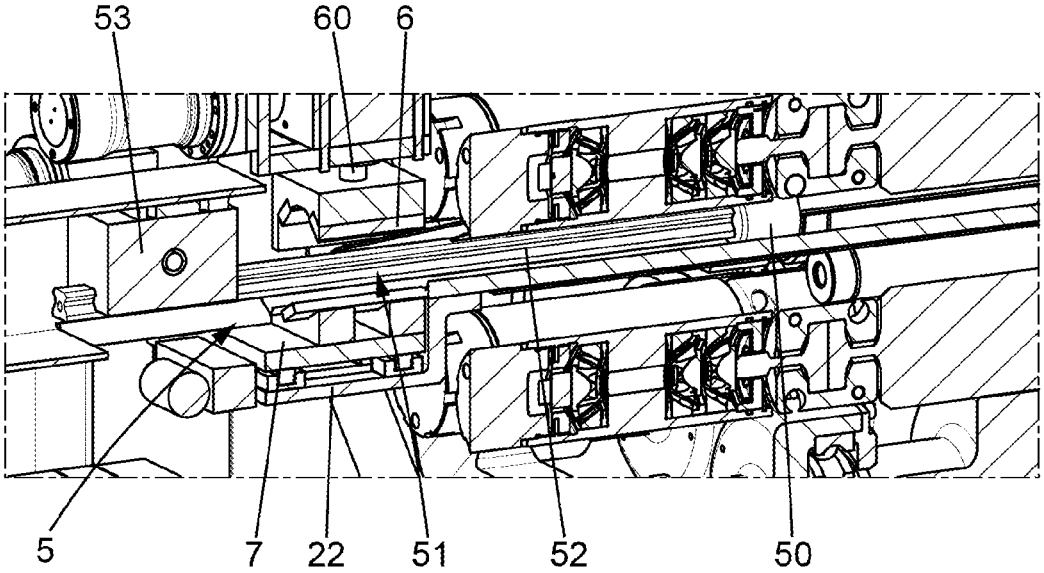
FIG. 8 is a view subsequent to FIG. 7 in which an electromagnetic suction cup type gripper of a gripping device is moved by an actuator until one end of the work roll is gripped.
Figure 9:
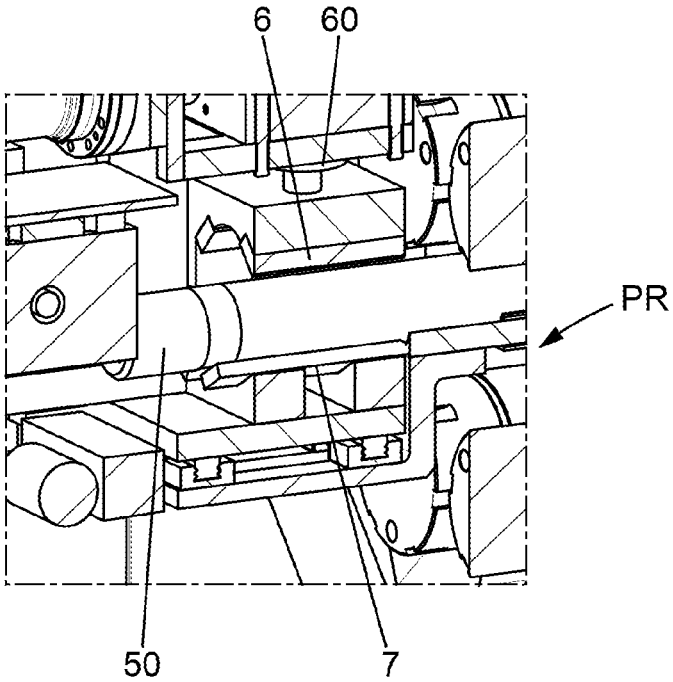
FIG. 9 is a view subsequent to FIG. 8, for which the work roll is pulled over the branches currently in a close position by the gripper, and into a position where the end of the work roll gripped is positioned between a movable backup element and a counter-backup element, intended to lock the work roll position.

Thus, when the gripper 50 is at the end of its retraction stroke, as visible in FIG. 8, it is noticed that the end of the work roll gripped is positioned on the counter-backup element 7, which extends from the branches 20, 21 of the fork system currently in the close position CP. The second actuator 60 is then configured to ensure that the movable backup element 6 is moved closer to the counter-backup element 7, until locking of the work roll on the fork system, clamped between both backup elements 6 and 7 is achieved.

Such a locking makes it possible to proceed with the complete removal of the work roll 12 by moving the whole of fork system and of the work roll locked between the movable backup element 6 and the counter-backup element 7, in particular when the work roll is the upper work roll which is then held by gravity against the branches 20, 21 upon removing, or when the work roll is a lower work roll currently positioned under the branches 20, 21 of the fork system.

In the case of removal of the upper work roll, this still allows deposition of the upper work roll, by turning the whole of the fork system/work roll locked between the backup elements 6, 7. The work roll 12 is then positioned by a robotic means on a removal support. The movable backup element 6 is spaced apart from the counter-backup element 7, then the gripper is deactivated, in order to ensure deposition of the work roll.

Thus, the removal step b) may comprise:

a first removal sub-step in which the gripper 50 grips the end of said work roll 12 and proceeds to partially remove the work roll 12 with respect to the fork system whose branches 12 are in the close position CP, immobile in the roll stand 10, by moving the work roll 12 along the branches 20, 21 of the fork system, a second removal sub-step in which a backup element 6, movable along a direction perpendicular to the direction of the branches, connected to said support by a second actuator 60, engages with the periphery of the work roll, in the proximity of the end gripped in order to ensure locking of the work roll, clamped between the motor-driven backup element 6, on the one hand, and a counter-backup element 7 in the vicinity of the fork support 12, a third removal sub-step in which the work roll locked between the backup element 6 and the counter-backup element 7 is removed entirely from the roll stand by moving the whole of the fork system and work roll locked.

According to one embodiment illustrated in the figures, the fork system 2, the gripping device 5 comprising in addition to said gripper 50, the actuator 51 connecting the support of the fork system to the gripper and the backup element 6 connected to the support by said second actuator 60 is a self-supporting assembly forming a same work roll change tool 8, handled by a robotic means Ro.

In FIG. 1, the robotic means Ro handling the work roll change tool 8 is represented in the work zone in front of the maintenance access of the roll stand.

An orthonormal reference frame (x,y,z) defines three directions in space, with:

the x-direction, namely the horizontal direction perpendicular to the running direction of the metal strip, the y-direction, namely the horizontal direction parallel to the running direction of the metal strip the z-direction, namely the vertical direction.

The robotic means Ro includes a motor carriage, movable along rails Rai oriented along the x-direction.

In the insertion step a) (or the removal step), the changing tool 8 is oriented in the axis of the work roll 12 to be gripped, with the parallel branches 20, 21, substantially contained in a plane parallel to the plane of the metal strip MS, oriented parallel to the axis of the work roll to be gripped.

For gripping the upper work roll 12, the gripping device is positioned above the branches 20, 21, whereas for gripping the lower work roll, both branches are above the gripping device 5.

The work roll changing tool 8 is mounted to a support S movably mounted through a motor unit along a column C carried by the carriage of the robotic means. By vertically moving the support S up (or down) along the column C, the height of the tool can be adjusted.

The tilt of the longitudinal axis of the changing tool parallel to the axis of the branches can be adjusted by a pivot P between the tool 8 and the support S via a motor unit. A further degree of freedom in pivoting allows the changing tool 8 to be pivoted about its longitudinal axis, and to allow the changing tool to be turned through 180°.

It is understood that the robotic means can take many other forms such as, for example, a six-axis robotic arm handling the work roll changing tool 8.

Thus, and according to one exemplary embodiment, the upper work roll and the lower work roll can advantageously be successively removed by said same work roll change tool 8, handled by the robotic means Ro, said robotic means comprising means for moving the self-supporting assembly:

along an x-direction parallel to the axis of the work roll 12 to be gripped, during the insertion step or the removal step, for example by moving the carriage along the rails Rai, in height along a direction z, to move from a position allowing extraction of the upper work roll to a position allowing extraction of the lower roll, especially by motor movement of the support S along the column C, by pivoting along an axis of rotation parallel to the direction of the branches of the fork system in order to move from a configuration of the self-supporting assembly allowing extraction of the upper work roll to a configuration in which the self-supporting assembly is pivoted through 180° allowing extraction of the lower work roll.

The method according to the present disclosure finds particular application in a 20Hi rolling mill as represented schematically in FIG. 12.

The present disclosure further relates to such a tool 8 suitable for changing work rolls configured to be handled by motor means Ro. This tool 8 comprises the fork system 2 comprising two branches 20, 21 configured to be inserted into the stand of a rolling mill in a spaced apart position SAP of the branches, on either side of an upper work roll 12 of the rolling mill, said branches 20, 21 being movable relative to a fork support 22, said branches 20, 21 being configured to move from their spaced apart position SAP to a close position CP in which the branches 20, 21 ensure lifting of the upper work roll 12 by guaranteeing the physical separation between the work roll 12 and the metal strip MS upon extracting a work roll.

The tool further comprises the gripping device 5 comprising the gripper 50 connected by an actuator 51 to the fork support, configured to grip an end of the work roll 12 and pull the work roll 12 along the branches 20, 21 of the fork system.

The work roll changing tool 8 may further comprise the movable backup element 6 connected by a second actuator 60 to the fork support 22 configured to ensure locking of the end of the work roll gripped and pulled by the gripping device 5, clamped between the movable backup element 6 and a counter-backup element 7 in the vicinity of the fork support, when the branches 20, 21 are in the close position CP.

It should be noted that this work roll change tool is suitable not only for extracting the work roll, but also for gripping and inserting a new, or ground, work roll into the rolling mill to replace the upper work roll.

Thus, the replacement of the work roll removed from the roll stand in the presence of the metal strip and the rolling elements, in particular the first intermediate rolls, can be carried out by reversing the steps of the method ensuring extraction of the work roll.

For the replacement of the upper roll, the new or ground work roll is inserted, locked along both branches 20, 21 of the fork system, currently in the close position CP, thus allowing insertion of the new or ground work roll 12 without any risk of marking with the metal strip MS, or even without any risk of marking with the rolling members, in particular both first intermediate rolls 13 when the tool further comprises the wings 3 and 4 with insert function. Said branches 20, 21 are movable with respect to a fork support 22, configured to move from their close position CP to their spaced apart position SAP to cause the upper work roll 12 to be deposited onto the metal strip MS. In this way, the upper work roll 12 is deposited in a controlled manner, without falling, especially by virtue of the slopes 25, 26 of the branches, which ensure a smooth descent of the work roll when the branches 20, 21 are spaced apart from each other.

Prior to this deposition by spacing apart the branches 20, 21 of the fork system, and when the tool comprises the movable backup element 6 and the counter-backup element 7, it is understood that the movable backup element 6 is spaced apart from the counter-backup element 7, so as to release the work roll; then the gripper 50 is pushed by the actuator 51 in order to completely push the work roll into the roll stand in the desired position, along the axial direction of the roll.

The tool may also comprise both wings 3, 4, with an insert function, respectively hingedly integral with both branches 20, 21 of the fork system and ensuring:

when both branches 20, 21, and concurrently the insert wings 3, 4, move closer, from their spaced apart position SAP to their close position CP, mechanical separation between the work roll 12 and the rolling members, in which said work roll and the rolling members are physically separated along the length of the work roll, by said insert wings 3, 4 guaranteeing suppression of the contact between the work roll and the rolling members, in particular suppression of both contact generatrices of the lower work roll with the rolling members, and/or releasing the lower work roll 12 onto the wings 3, 4 as an insert between the work roll 12 and the rolling members, in the close position CP of the branches in the roll stand, and then the deposition of the lower work roll onto the rolling members when the branches 20, 21 and the wings 3, 4 as an insert have moved from their close position CP to their spaced apart position SAP.

The wings 3 and 4 with insert function are thus of interest upon extracting the work roll; both wings are inserted between the lower or upper work roll 12 and the rolling members, in particular the first two intermediate rolls 13, advantageously avoiding any marking of the work roll and the first two intermediate rolls upon moving the work roll, either by the gripping device, or by the movement caused by the robotic means when the work roll is completely extracted from the roll stand.

These wings 3 and 4 are also of considerable interest for ensuring replacement of the work roll removed from the roll stand, in the presence of the metal strip, and of the rolling elements, in particular of the first intermediate rolls, by suppressing the risk of marking between the new (or ground) roll and the first two intermediate rolls.

In particular and with regard to the insertion of the new or ground lower work roll, and when the unlocking of the movable backup element and the deactivation of the gripper may cause a (very slight) fall; this fall is advantageously triggered in the close position CP of the branches 20 and 21 and therefore of the wings so that the release of the lower, new or ground work roll takes place on the wings 3, 4, thus avoiding the risk of marking between the work roll 12 and the first intermediate rolls during this release. The work roll is then partially inserted into the roll stand, and before the gripper completely pushes the work roll into the roll stand.

Figure 11:
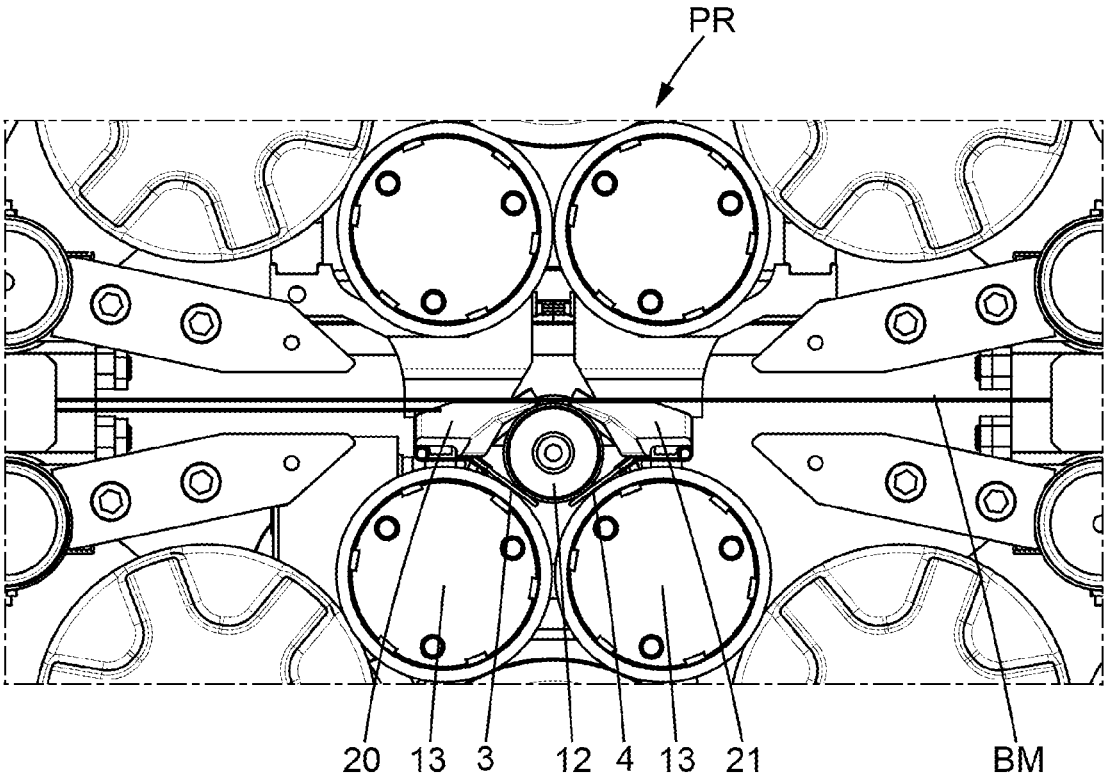
FIG. 11 is a cross-sectional view, subsequent to FIG. 10, with both arms moved to their close position, both wings integral with both arms concurrently ensuring mechanical separation between the lower work roll, on the one hand, and the first two intermediate rolls, on the other hand, with suppression of both contact generatrices between the work roll and the first intermediate rolls.

Secondly, the new or ground roll is deposited onto the rolling elements, especially the first intermediate rolls, by moving the arms from their close position, visible in FIG. 11, to their spaced apart position, which results in the removal of the wings 3, 4, respectively between the work roll and both first intermediate rolls, as visible in FIG. 10.

Such a tool thus advantageously makes it possible not only to extract the work rolls without risk of marking the work roll, but also to insert a new or ground work roll, especially a mirror-finish one, and advantageously without risk of marking the new or ground work roll, which is a great advantage.

Thus, in general, the present disclosure still relates to a method for changing the work roll suitable for inserting a work roll into the roll stand in the presence of the metal strip and the rolling elements. This method is particularly advantageous in that it suppresses or greatly reduces the risk of friction of the new or ground work roll and thus of scratching the work roll.

Thus, the present disclosure also relates to a method for changing the work rolls 12 of a rolling mill 10 in the presence of a metal strip MS to be rolled between both work rolls 12, including an upper work roll and a lower work roll, and wherein in a closing position of the roll stand configured to roll the metal strip MS, said work rolls 12 each have a contact generatrix with the metal strip, the contact generatrices and the axes of the work rolls lying in a plane substantially perpendicular to a running direction of the metal strip, rolling members, such as first intermediate rolls 13, being in contact along two contact generatrices between each of the work rolls 12 and the rolling members, the rolling members ensuring transmission of a rolling force to the lower and upper work rolls 12 in contact with the metal strip MS, method in which the insertion of the work rolls 12, in particular new or ground work rolls, into the roll stand in the presence of the metal strip and the rolling members is ensured after at least partially opening the roll stand by carrying out the following steps, for said upper and/or lower work roll an insertion step c) comprising:

robotically inserting mechanical separation means 1 between the metal strip MS and the work roll to be inserted ensuring removal of the contact between the work roll 12 and the metal strip MS and/or a robotic insertion of mechanical separation means 1 between the rolling members and said work roll 12 to be inserted guaranteeing suppression of the contact between the work roll 12 and the rolling members an insertion step d), concurrent or subsequent to the insertion step c) comprising robotically inserting said work roll 12, by pushing an end of said work roll 12 and moving said work roll along its axis with respect to the metal strip MS and the rolling members present in the roll stand, wherein said mechanical separation means are:

in a separation position SP1 in which the work roll 12 and the metal strip MS are physically separated so as to avoid any friction between the work roll and the metal strip upon moving, or/and in a separation position SP2 in which the work roll 12 and the rolling members are physically separated and so as to avoid any friction between the work roll and the rolling members upon moving.

Thus and notably, the method comprises an insertion step c), prior to or together with the insertion step d), with robotically inserting mechanical separation means guaranteeing suppression of the contact between the work roll 12 and the metal strip MS, in the separation position SP1, and alternatively or preferably additionally, with robotically inserting mechanical separation means guaranteeing suppression of the contact between the work roll 12 and the rolling members, in the separation position SP2.

The step of inserting d) the work roll is then carried out while said mechanical separation means are in said separation position SP1 in which the work roll 12 and the metal strip MS are physically separated or/and preferably in said separation position SP2 in which the work roll 12 and the backup members are physically separated.

The method according to the present disclosure advantageously makes it possible, during the insertion step d), to avoid any friction between the new, or ground work roll, to be inserted, on the one hand, and the metal strip and/or the rolling members, on the other hand, upon moving the work roll for inserting it into the roll stand.

It becomes possible to insert the lower or upper work roll without marking the work roll, or without marking neither the metal strip nor the rolling elements upon removing the work roll by moving along its axis.

Thus, the method can have the insertion step c) comprising robotically inserting the mechanical separation means between said upper or lower work roll 12 to be inserted and the metal strip MS to the separation position SP1 in which the metal strip MS and said upper or lower work roll 12 are physically separated along the length of the work roll, guaranteeing suppression of the contact between the work roll and the metal strip, and inserting in which said work roll insertion is robotically performed, by moving said work roll 12 along its axis with respect to the metal strip and the rolling members, in said separation position SP1 in which the upper or lower work roll 12 and the metal strip MS are physically separated so as to avoid any friction between the work roll and the metal strip upon moving.

The method according to the present disclosure can be advantageously implemented by a roll changing tool 8 especially as previously described for extraction, comprising a fork system, with two branches 20, 21. When the branches 20, 21 are inserted between the metal strip MS and the work roll 12 to be inserted, parallel to the axis of the work roll, said branches 20, 21 are advantageously interposed between the metal strip MS and the work roll 12 enable suppression of the contact between the metal strip and the work roll to be guaranteed.

Thus, the insertion step c) and the insertion step d) can be implemented for the upper work roll 12, and by inverting the steps described for the extraction and as visible from FIGS. 5 to 9, the separation means 1 between said upper work roll 12 and the metal strip MS comprising said fork system 2 with its two branches 20, 21, parallel to each other, held to a same fork support 22.

Thus, the insertion step c) and the insertion step d) can be implemented for the upper work roll 12. Said separation means 1 between said upper work roll 12, and the metal strip MS may comprise a fork system 2 comprising two branches 20, 21, parallel to each other, held to a same fork support 22. Both branches of the fork system are movable with respect to said fork support, to assume, on the one hand, during the insertion step c) and the insertion step d) a close position CP in which both branches of the fork system are moved closer to each other, configured so as to come into contact respectively with two generatrices of the upper work roll 12 to move the upper work roll apart from the metal strip MS, then, on the other hand, a spaced apart position SAP, configured to ensure deposition of the upper work roll 12 onto the metal strip with the presence of a contact generatrix between the upper work roll and the metal strip, both branches then being arranged on either side of the upper work roll.

Thus and according to this embodiment, it is possible to insert the upper work roll 12 during the insertion step d), between the metal strip MS and the rolling members, without any risk of friction between the work roll and the metal strip MS by virtue of the branches 20, 21 of the fork system, interposed between the work roll and the metal strip, in their close position CP and as illustrated in FIG. 7. Once the work roll 12 is inserted in position in the roll stand, the deposition is achieved by spacing apart the branches 20, 21 to their spaced apart position SAP, which causes the descent of the work roll until it comes into contact with the metal strip MS, by gravity, and as illustrated in FIG. 6.

According to one embodiment, both branches 20, 21 of the fork system 2 may have the section, along a plane perpendicular to the direction of the branches 20, 21, comprising two slopes 25, 26, belonging respectively to both branches 20, 21 facing each other, tilted with respect to the plane of the metal strip MS along the running direction of the metal strip, both slopes 25, 26 being configured to come into contact with two generatrices of the upper work roll 12 to ensure holding of the upper work, forming cradle for holding the upper work roll 12, in the close position CP of the branches 20, 21 of the fork system 2, and then a controlled deposition of the upper work roll onto the metal strip, by virtue of the slopes 25, 26 when both branches are moved to their spaced apart position SAP.

With respect to the lower work roll 12, the insertion step c) and the insertion step d) can be implemented for the lower work roll, and wherein said mechanical separation means between said work roll and the metal strip comprise a fork system 2 comprising two branches 20, 21, parallel to each other, held to a same fork support 22 and wherein both branches of said fork system have free ends 23, provided with slopes 24, which when both branches 20, 21 of the fork system have axes contained in a plane parallel to the plane of the metal strip MS, are tilted with respect to the plane of the metal strip MS, along the direction perpendicular to the running direction of the metal strip.

The slopes 24 at the ends of the branches 21 are configured to cooperate with the edge of the metal strip MS to lift the metal strip upon inserting the branches 20, 21 in a movement parallel to the direction of the lower work roll, with the metal strip MS being spaced apart from the lower work roll 12.

Thus, and as understandable from FIG. 11, the insertion of the branches of the fork system, with the slopes 24 at the ends of the branches 20, 21 allows the metal strip MS to be lifted, and both branches 20, 21 to be provided as a mechanical separation preventing any friction between the lower work roll and the metal strip upon inserting it.

The lifting of the metal strip, by working the slopes 24, can be carried out in the close position CP of the branches 20, 21 of the fork system, or even in conjunction with the insertion of the lower work roll, currently positioned just below the branches 20, 21 of the fork system during the insertion step d), and much as the example of the working of the slopes upon extracting the work roll (FIGS. 13 and 14).

According to one advantageous embodiment, the method allows not only to avoid friction between the (upper or lower) work roll 12 to be inserted and the metal strip MS, but also to avoid friction between said (lower or upper) work roll and the rolling members, in particular between the upper work roll 12 and the upper first intermediate rolls 13, or between the lower work roll 12 and the lower first intermediate rolls 13.

To this end, said insertion step c) comprises:

said robotically inserting the mechanical separation means 1 between the metal strip MS and the work roll to be inserted guaranteeing suppression of the contact between the work roll 12 and the metal strip MS, and said robotically inserting mechanical separation means 1 between the rolling members and said work roll 12 to be inserted guaranteeing suppression of the contact between the work roll 12 and the rolling members, and wherein said insertion step d) comprises robotically inserting said work roll, by pushing an end of said work roll and moving said work roll along its axis with respect to the metal strip MS and the rolling members, and wherein said mechanical separation means 1 are:

in said separation position SP1 in which the work roll 12 and the metal strip 2 are physically separated so as to avoid any friction between the work roll and the metal strip upon moving, and simultaneously in said separation position SP2 in which the work roll (12) and the rolling members are physically separated and so as to avoid any friction between the work roll and the rolling members upon moving.

To this end, and according to one embodiment, the separation means between said work roll and the metal strip may comprise said fork system 2, including both branches 20, 21, movable with respect to each other to move from a close position CP in which both branches 20, 21 of the fork system are interposed between said upper or lower work roll 12 and the metal strip MS ensuring suppression of the contact between the work roll 12 and the metal strip MS during the insertion step c) and the insertion step d) and wherein the mechanical separation means between said work roll 12 and the rolling members comprise additionally, two wings 3, 4, with an insert function, respectively integral with said two branches 20, 21 of the fork system and concurrently ensuring, in a close CP position, mechanical separation between the work roll and the rolling members wherein said work roll 12 and the rolling members are physically separated along the length of the work roll, by said wings 3, 4 as an insert, ensuring suppression of the contact between the work roll 12 and the rolling members during the insertion step c) and the insertion step d)

For example the insertion step c) and the insertion step d) are implemented for the upper work roll 12, and wherein said separation means 1 between said upper work roll 12 and the metal strip MS comprise the fork system 2 comprising two branches 20, 21, parallel to each other, held to a same fork support 22.

Both branches of the fork system are movable with respect to said fork support, in order to assume, on the one hand, during the insertion step c) and the insertion step d), a close position CP in which both branches 20, 21 of the fork system are moved closer to each other, configured so as to come into contact respectively with two generatrices of the upper work roll 12 in order to space apart the upper work roll from the metal strip MS, both wings 3, 4 concurrently ensuring mechanical separation between the work roll 12 and the rolling members, and then, on the other hand, a spaced apart position SAP, configured to ensure deposition of the upper work roll 12 onto the metal strip MS with a contact generatrix between the upper work roll 12 and the metal strip. In their spaced apart position SAP, both branches are then arranged on either side of the upper work roll, which concurrently causes the wings 3, 4 to retract into a spaced apart position where the latter release interspaces between the work roll and the rolling members.

According to one embodiment, pushing the end of the work roll 12 in the insertion step d) is implemented by a gripper 5 comprising a gripper 50 configured to push the end of the work roll and wherein the insertion step d) is implemented by moving the gripper 50 along the direction of the work roll providing pushing of the work roll 12.

According to one embodiment, the gripper 5 further comprises an actuator 51 connecting the fork support 22 to the gripper 50, configured to move the gripper 50 relative to the fork support 22, along a direction parallel to the branches of the fork system, the insertion step d) comprising:

a first, insertion, sub-step in which the work roll 12, locked between a backup element 6 and a counter-backup element 7 on board the fork support is partially inserted into the roll stand between the metal strip MS and the upper or lower work roll 12 the branches 20, 21 of the fork system, or even the wings 3, 4 in their close position CP, guaranteeing suppression of the contact between the metal strip MS and the work roll 12, possibly guaranteeing suppression of the contact between the work roll and the rolling members by the wings 3, 4 as an insert, a second, unlocking, sub-step in which said movable backup element 6, connected to said support by a second actuator 60 along a direction perpendicular to the direction of the branches is spaced apart from the counter-backup element to release (unlock) the work roll, a third, insertion, sub-step in which the partially inserted work roll is pushed by the actuator 51 to its final axial position in the roll stand, by sliding the upper work roll onto the branches 20, 21 of the system, the fork currently in the close position CP, or even sliding the lower roll onto the insert wings 3, 4.

Depositing the upper work roll 12 is ensured by spacing apart the branches 20, 21 from their close position CP to their spaced apart position SAP, which also causes the wings 3, 4 to retract, with releasing the interspace between the work roll and the rolling members, especially the first two upper intermediate rolls 13.

Depositing the lower work roll 12 is ensured by spacing apart the branches 20, 21, and thus concurrently spacing apart the wings 3, 4 as an insert until their spaced apart position SAP in which the lower work roll 12 comes into contact with the rolling members, in particular with both first lower intermediate rolls 13, and along both contact generatrices between the work roll and respectively both first lower intermediate rolls 13.

The work roll change tool 8, handled by a robotic means Ro, as previously described may be suitable for implementing the insertion step a) and the removal step b) for extracting the work rolls.

The work roll changing tool 8, handled by a robotic means Ro, as previously described may be further suitable, for implementing the insertion steps c) and the insertion step d) for inserting the new or ground work rolls.

The present disclosure makes it possible to avoid damage to the metal strip, to the rolling members such as the first intermediate rolls, but also to the work roll, not only upon extracting the work roll from the roll stand, but also advantageously upon inserting a new or ground work roll.

The invention claimed is:

1. A method for changing work rolls of a rolling mill in the presence of a metal strip to be rolled between both work rolls, including an upper work roll and a lower work roll, and wherein in a closing position of the roll stand configured to roll the metal strip, said work rolls each have a contact generatrix with the metal strip, the contact generatrices and the axes of the work rolls lying in a plane substantially perpendicular to a running direction of the metal strip, rolling members, including first intermediate rolls being in contact along two contact generatrices between each of the work rolls and the rolling members, the rolling members ensuring transmission of a rolling force to the lower and upper work rolls in contact with the metal strip, the method comprising: extracting the work rolls from the roll stand after at least partially opening the roll stand for which the work rolls are spaced apart from each other with respect to the positions of the work rolls in the closing position of the roll stand by carrying out the following steps, for said upper and/or lower work roll:

an insertion step a) comprising:

robotically inserting mechanical separation means between said work roll and the metal strip to a separation position in which the metal strip and said work roll are physically separated along the length of the work roll, and up to ensuring removal of the contact between the work roll and the metal strip, and robotically inserting mechanical separation means between the work roll and the rolling members to a separation position in which said work roll and the rolling members are physically separated along the length of the work roll, until ensuring suppression of the contact between the work roll and the rolling members;

a removal step b) comprising:

robotically extracting said work roll, by gripping one end of said work roll and moving said work roll along its axis with respect to the metal strip and the rolling members present in the roll stand, wherein said mechanical separation means are:

in said separation position in which the work roll and the metal strip are physically separated so as to avoid any friction between the work roll and the metal strip upon moving, and in said separation position in which the work roll and the rolling members are physically separated and so as to avoid any friction between the work roll and the rolling members upon moving, and wherein said mechanical separation means comprises:

a fork system comprising two branches configured to be inserted in the stand of a rolling mill in a spaced apart position of the branches on either side of an upper work roll of the rolling mill, said branches being movable with respect to a fork support, said branches being configured to move from their spaced apart position to a close position in which the branches ensure lifting of the upper work roll by guaranteeing physical separation between the work roll and the metal strip upon extracting a work roll, and/or the fork system comprising both branches configured to be inserted in the stand of a rolling mill in their close position, said branches being movable with respect to a fork support, configured to move from their close position to their spaced apart position to cause deposition of the upper work roll from the metal strip; and a gripping device, comprising a gripper connected by an actuator to the fork support, configured to grip one end of the work roll and pull the work roll along the branches of the fork system.

2. The method according to claim 1, having the insertion step a) comprising robotically inserting the mechanical separation means between said upper or lower work roll, and the metal strip to the separation position in which the metal strip and said upper or lower work roll, are physically separated along the length of the work roll, guaranteeing suppression of the contact between the work roll and the metal strip and extraction in which said extraction of the work roll is robotically performed, by moving said work roll along its axis with respect to the metal strip and the rolling members, in said separation position in which the upper or lower work roll, and the metal strip are physically separated so as to avoid any friction between the work roll and the metal strip upon moving.

3. The method according to claim 2, wherein the insertion step a) and the extraction step b) are implemented for the upper work roll, and wherein both branches of the fork system are movable with respect to said fork support, to assume, on the one hand, a spaced apart position configured to ensure insertion of both branches of the fork on either side of the upper work roll, without friction with said upper work roll still in contact with the metal strip via the contact generatrix, and on the other hand a close position in which both branches of the fork system are moved closer to each other, configured so as to come into contact respectively with two generatrices of the upper work roll in order to space apart the upper work roll from the metal strip by lifting it, suppressing contact between the upper work roll and the metal strip.

4. The method according to claim 2, wherein the insertion step a) and the extraction step b) are carried out for the lower work roll, and wherein both branches of said fork system have free ends, provided with slopes, which when both branches of the fork system have axes contained in a plane parallel to the plane of the metal strip, are tilted with respect to the plane of the metal strip, along the direction perpendicular to the running direction of the metal strip, said slopes at the ends of the branches being configured to cooperate with the edge of the metal strip to lift the metal strip upon insertion of the branches in a movement parallel to the direction of the lower work roll, with spacing apart the metal strip from the lower work roll and suppressing contact between the lower work roll and the metal strip.

5. The method according to claim 3, wherein both branches of the fork system have a cross-section, in a plane perpendicular to the direction of the branches, comprising two slopes, belonging respectively to both branches facing each other, which are tilted with respect to the plane of the metal strip in the running direction of the metal strip, both slopes being configured to come into contact with two generatrices of the upper work roll to ensure lifting of the upper work roll, forming a cradle for holding the upper work roll, in the close position of the branches of the fork system.

6. The method according to claim 1, wherein said insertion step a) comprises:

said robotically inserting the mechanical separation means between said work roll and the metal strip to the separation position in which the metal strip and said work roll are physically separated along the length of the work roll, and up to guaranteeing suppression of the contact between the work roll and the metal strip, and said robotically inserting the mechanical separation means between the work roll and the rolling members to the separation position in which said work roll and the rolling members are physically separated along the length of the work roll, up to guaranteeing suppression of the contact between the work roll and the rolling members and wherein said removal step b) comprises robotically extracting said work roll, by gripping one end of said work roll and moving said work roll along its axis with respect to the strip and the rolling members, and wherein said mechanical separation means are:

in said separation position in which the work roll and the metal strip are physically separated so as to avoid any friction between the work roll and the metal strip upon moving, and simultaneously in said separation position in which the work roll and the rolling members are physically separated and so as to avoid any friction between the work roll and the rolling members upon moving.

7. The method according to claim 3, wherein said insertion step a) comprises:

said robotically inserting the mechanical separation means between said work roll and the metal strip to the separation position in which the metal strip and said work roll are physically separated along the length of the work roll, and up to guaranteeing suppression of the contact between the work roll and the metal strip, and said robotically inserting the mechanical separation means between the work roll and the rolling members to the separation position in which said work roll and the rolling members are physically separated along the length of the work roll, up to guaranteeing suppression of the contact between the work roll and the rolling members;

wherein said removal step b) comprises robotically extracting said work roll, by gripping one end of said work roll and moving said work roll along its axis with respect to the strip and the rolling members, and wherein said mechanical separation means are:

in said separation position in which the work roll and the metal strip are physically separated so as to avoid any friction between the work roll and the metal strip upon moving, and simultaneously in said separation position in which the work roll and the rolling members are physically separated and so as to avoid any friction between the work roll and the rolling members upon moving; and wherein the mechanical separation means between said work roll and the rolling members comprise two wings, with an insert function, respectively hingedly integral with both branches of the fork system and concurrently ensuring, upon moving both branches from their spaced apart position to their close position, mechanical separation between the work roll and the rolling members, in which said work roll and the rolling members are physically separated along the length of the work roll, by said wings as an insert, guaranteeing suppression of the contact between the work roll and the rolling members.

8. The method according to claim 1, wherein gripping the end of the work roll during the removal step b) is implemented by said gripping device, gripping device configured to grip the end of the work roll comprising a gripper with an electromagnetic suction cup or a pneumatic suction cup cooperating with a base of the roll, or having a clamp whose jaws engage the cylindrical periphery of the end of the roll, and wherein the removal step b) is implemented by moving the gripper in the direction of the work roll ensuring pulling of the work roll.

9. The method according to claim 3, wherein said insertion step a) comprises:

said robotically inserting the mechanical separation means between said work roll and the metal strip to the separation position in which the metal strip and said work roll are physically separated along the length of the work roll, and up to guaranteeing suppression of the contact between the work roll and the metal strip, and said robotically inserting the mechanical separation means between the work roll and the rolling members to the separation position in which said work roll and the rolling members are physically separated along the length of the work roll, up to guaranteeing suppression of the contact between the work roll and the rolling members; and wherein said removal step b) comprises robotically extracting said work roll, by gripping one end of said work roll and moving said work roll along its axis with respect to the strip and the rolling members, and wherein said mechanical separation means are:

in said separation position in which the work roll and the metal strip are physically separated so as to avoid any friction between the work roll and the metal strip upon moving, and simultaneously in said separation position in which the work roll and the rolling members are physically separated and so as to avoid any friction between the work roll and the rolling members upon moving;

wherein the gripping device further comprises said gripper, but also an actuator connecting the fork support to the gripper, configured to move the gripper relative to the fork support, along a direction parallel to the branches of the fork system, the removal step b) comprising:

a first removal sub-step in which the gripper grips the end of said work roll and performs partial removal of the work roll with respect to the fork system whose branches are, in the close position, immobile in the roll stand, by moving the work roll along the branches of the fork system, a second removal sub-step in which a backup element, movable along a direction perpendicular to the direction of the branches, connected to said support by a second actuator, engages the periphery of the work roll, in proximity of the end gripped to ensure locking of the work roll, clamped between the motor-driven backup element, on the one hand, and a counter-backup element in the vicinity of the fork support, and a third removal sub-step in which the work roll locked between the backup element and the counter-backup element is entirely removed from the roll stand by moving the whole of the fork system and work roll locked.

10. The method according to claim 9, wherein the fork system, the gripping device further comprising said gripper, but also an actuator connecting the support of the fork system to the gripper and the back-up element connected to the support by said second actuator is a self-supporting assembly forming a same work roll change tool, handled by a robotic means.

11. The method according to claim 10, wherein the upper work roll and the lower work roll are successively removed by said same work roll change tool, handled by robotic means, said robotic means comprising means for moving the self-supporting assembly:

in an x-direction parallel to the axis of the work roll to be gripped, during the insertion step or the removal step, in height along a z-direction, to move from a position allowing extraction of the upper work roll to a position allowing extraction of the lower roll, in pivot along an axis of rotation parallel to the direction of the branches of the fork system to move from a configuration of the self-supporting assembly allowing extraction of the upper work roll to a configuration in which the self-supporting assembly is pivoted by 180° enabling extraction of the lower work roll.

12. A method for changing work rolls of a rolling mill in the presence of a metal strip to be rolled between both work rolls, including an upper work roll and a lower work roll, and wherein in a closing position of the roll stand configured to roll the metal strip, said work rolls each have a contact generatrix with the metal strip, the contact generatrices and the axes of the work rolls lying in a plane substantially perpendicular to a running direction of the metal strip, rolling members such as first intermediate rolls being in contact along two contact generatrices between each of the work rolls and the rolling members, the rolling members ensuring transmission of a rolling force to the lower and upper work rolls in contact with the metal strip, the method comprising inserting the new or ground work rolls, into the roll stand is ensured in the presence of the metal strip and the rolling members, after at least partially opening the roll stand by the implementation of the following steps, for said upper and/or lower work roll:

an insertion step a) comprising:

robotically inserting mechanical separation means between the metal strip and the work roll to be inserted guaranteeing suppression of the contact between the work roll and the metal strip, and robotically inserting mechanical separation means between the rolling members and said work roll to be inserted guaranteeing suppression of the contact between the work roll and the rolling members;

an insertion step b), concurrent or subsequent to the insertion step a) comprising robotically inserting said work roll, by pushing one end of said work roll and moving said work roll along its axis with respect to the metal strip and to the rolling members present in the roll stand, wherein said mechanical separation means are:

in a separation position in which the work roll and the metal strip are physically separated so as to avoid any friction between the work roll and the metal strip upon moving, and in a separation position in which the work roll and the rolling members are physically separated and so as to avoid any friction between the work roll and the rolling members upon moving wherein said mechanical separation means comprises:

a fork system comprising two branches configured to be inserted in the stand of a rolling mill in a spaced apart position of the branches on either side of an upper work roll of the rolling mill, said branches being movable with respect to a fork support, said branches being configured to move from their spaced apart position to a close position in which the branches ensure lifting of the upper work roll by guaranteeing physical separation between the work roll and the metal strip upon extracting a work roll, and/or the fork system comprising both branches configured to be inserted in the stand of a rolling mill in their close position, said branches being movable with respect to a fork support, configured to move from their close position to their spaced apart position to cause deposition of the upper work roll from the metal strip; and a gripping device, comprising a gripper connected by an actuator to the fork support, configured to grip one end of the work roll and pull the work roll along the branches of the fork system.

13. The method according to claim 12, having the insertion step a) comprising robotically inserting mechanical separation means between said upper or lower work roll to be inserted and the metal strip to the separation position in which the metal strip and said upper or lower work roll are physically separated along the length of the work roll, guaranteeing suppression of the contact between the work roll and the metal strip and the insertion step b) in which said inserting the work roll is robotically performed, by moving said work roll along its axis with respect to the metal strip and the rolling members, in said separation position in which the upper or lower work roll and the metal strip are physically separated so as to avoid any friction between the work roll and the metal strip upon moving.

14. The method according to claim 12, wherein the insertion step a) and the insertion step b) are implemented for the upper work roll, and wherein both branches of the fork system are movable with respect to said fork support, to assume, on the one hand, during the insertion step a) and the insertion step b) a close position in which both branches of the fork system are moved closer to each other, configured so as to come into contact respectively with two generatrices of the upper work roll to space apart the upper work roll from the metal strip on the other hand, and then a spaced apart position, configured to ensure deposition of the upper work roll onto the metal strip with a contact generatrix between the upper work roll and the metal strip, both branches then being arranged on either side of the upper work roll.

15. The method according to claim 13, wherein the insertion step a) and the insertion step b) are carried out for the lower work roll, and wherein both branches of said fork system have free ends, provided with slopes, which when both branches of the fork system are of axes contained in a plane parallel to the plane of the metal strip, are tilted with respect to the plane of the metal strip, along the direction perpendicular to the running direction of the metal strip, said slopes at the ends of the branches being configured to cooperate with the edge of the metal strip to lift the metal strip upon inserting the branches in a movement parallel to the direction of the lower work roll, with spacing apart the metal strip from the lower work roll.

16. The method according to claim 14, wherein both branches of the fork system have a cross-section, along a plane perpendicular to the direction of the branches, comprising two slopes, belonging respectively to both branches facing each other, tilted with respect to the plane of the metal strip along the running direction of the metal strip, both slopes being configured to come into contact with two generatrices of the upper work roll to ensure holding of the upper work, forming cradle for holding the upper work roll, in the close position of the branches of the fork system, and then controlled deposition of the upper work roll onto the metal strip when both branches are moved to their spaced apart position.

17. The method according to claim 12, wherein said insertion step a) comprises:

said robotically inserting the mechanical separation means between the metal strip and the work roll to be inserted guaranteeing suppression of the contact between the work roll and the metal strip, and said insertion step of robotically inserting mechanical separation means between the rolling members and said work roll to be inserted ensuring suppression of the contact between the work roll and the rolling members and wherein said insertion step b) comprises robotically inserting said work roll, by pushing one end of said work roll and moving said work roll along its axis with respect to the strip and the rolling members, and wherein said mechanical separation means are:

in said separation position in which the work roll and the metal strip are physically separated so as to avoid any friction between the work roll and the metal strip upon moving, and simultaneously in said separation position in which the work roll and the rolling members are physically separated and so as to avoid any friction between the work roll and the rolling members upon moving.

18. The method according to claim 14, wherein said insertion step a) comprises:

said robotically inserting the mechanical separation means between the metal strip and the work roll to be inserted guaranteeing suppression of the contact between the work roll and the metal strip, and said insertion step of robotically inserting mechanical separation means between the rolling members and said work roll to be inserted ensuring suppression of the contact between the work roll and the rolling members wherein said insertion step b) comprises robotically inserting said work roll, by pushing one end of said work roll and moving said work roll along its axis with respect to the strip and the rolling members, and wherein said mechanical separation means are:

in said separation position in which the work roll and the metal strip are physically separated so as to avoid any friction between the work roll and the metal strip upon moving, and simultaneously in said separation position in which the work roll and the rolling members are physically separated and so as to avoid any friction between the work roll and the rolling members upon moving, wherein both branches of the fork system are interposed between said upper or lower work roll and the metal strip guaranteeing suppression of the contact between the work roll and the metal strip during the insertion step a) and the insertion step b) and wherein the mechanical separation means between said work roll and the rolling members comprise two wings, with an insert function, respectively hingedly integral with said two branches of the fork system and concurrently ensuring, in a close position, the mechanical separation between the work roll and the rolling members in which said work roll and the rolling members are physically separated along the length of the work roll, by said insert wings guaranteeing suppression of the contact between the work roll and the rolling members during the insertion step a) and the insertion step b).

19. The method according to claim 18, wherein the insertion step a) and the insertion step b) are implemented for the upper work roll, and wherein said separation means between said upper work roll, and the metal strip comprise the fork system comprising two branches parallel to each other, held to a same fork support and in which both branches of the fork system are movable with respect to said fork support, to assume, on the one hand, during the insertion step a) and the insertion step b) a close position in which both branches of the fork system are moved closer to each other, configured so as to come into contact respectively with two generatrices of the upper work roll in order to space apart the upper work roll from the metal strip, both wings concurrently ensuring mechanical separation between the work roll and the rolling members, and then, on the other hand, a spaced apart position, configured to ensure deposition of the upper work roll onto the metal strip with a contact generatrix between the upper work roll and the metal strip, both arms then being arranged on either side of the upper work roll, and concurrently retraction of the wings into a spaced apart position in which they release the interspaces between the work roll and the rolling members.

20. The method according to claim 12, wherein pushing the end of the work roll in the insertion step b) is implemented by said gripper device comprising the gripper configured to push the end of the work roll and wherein the insertion step b) is implemented by moving the gripper along the direction of the work roll ensuring pushing of the work roll.

21. The method according to claim 20, wherein the gripper further comprises an actuator connecting the fork support to the gripper, configured to move the gripper relative to the fork support, in a direction parallel to the branches of the fork system, the insertion step b) comprising:

a first insertion sub-step in which the work roll locked between a backup element and a counter-backup element on board the fork support is partially inserted into the roll stand between the metal strip and the upper or lower work roll, the branches of the fork, or even the wings in their close position guaranteeing suppression of the contact between the metal strip and the work roll, with possibly guaranteeing suppression of the contact between the work roll and the rolling members by the wings, a second, unlocking, sub-step in which said backup element, which is movable and connected to said support by a second actuator along a direction perpendicular to the direction of the branches, is spaced apart from the counter-backup element in order to release the work roll, a third insertion sub-step in which the work roll partially inserted is pushed by the actuator by sliding the upper work roll on the branches of the system, the fork then in the close position, or even sliding the lower roll on the insert wings.

22. The method according to claim 1, wherein said rolling mill is a 20 HI rolling mill.

23. A tool suitable for changing the work rolls of a rolling mill according to the method of claim 1, said tool configured to be handled by motor-driven means (Ro) comprising:

a fork system comprising two branches configured to be inserted in the stand of a rolling mill in a spaced apart position of the branches on either side of an upper work roll of the rolling mill, said branches being movable with respect to a fork support, said branches being configured to move from their spaced apart position to a close position in which the branches ensure lifting of the upper work roll by guaranteeing physical separation between the work roll and the metal strip upon extracting a work roll, and/or the fork system comprising both branches configured to be inserted in the stand of a rolling mill in their close position, said branches being movable with respect to a fork support, configured to move from their close position to their spaced apart position to cause deposition of the upper work roll from the metal strip; and a gripping device, comprising a gripper connected by an actuator to the fork support, configured to grip one end of the work roll and pull the work roll along the branches of the fork system.

24. The tool according to claim 23 comprising a movable backup element connected by a second actuator to the fork support configured to ensure locking of the end of the work roll gripped and pulled by the gripping device, clamped between the movable backup element and a counter-backup element in the vicinity of the fork support, when the branches are in the close position.

25. The tool according to claim 23, comprising two wings, with an insert function, respectively hingedly integral with both branches of the fork system and ensuring:

when both arms, and concurrently the wings as an insert, are moved closer, from their spaced apart position to their brought-together position, the mechanical separation between the work roll and the rolling members, in which said work roll and the rolling members are physically separated over the length of the work roll, by said insert wings guaranteeing suppression of the contact between the work roll and the rolling members, in particular suppression of both generatrices of the contact of the lower work roll with the rolling members, and/or releasing the lower work roll onto the insert wings between the work roll and the rolling members, in the close position of the branches in the roll stand, and then removing the lower work roll onto the rolling members when the branches and the insert wings have moved from their close position to their spaced apart position.

* * * * *